US007934286B2

(12) United States Patent
Yoo et al.

(10) Patent No.: US 7,934,286 B2
(45) Date of Patent: May 3, 2011

(54) UPRIGHT VACUUM CLEANER WITH A SINGLE FRAME SUPPORT FOR A SEPARABLE CLEANER BODY

(75) Inventors: Dong-hun Yoo, Gwangju (KR); Ji-ho Seo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 991 days.

(21) Appl. No.: 11/812,196

(22) Filed: Jun. 15, 2007

(65) Prior Publication Data

US 2008/0148510 A1 Jun. 26, 2008

(30) Foreign Application Priority Data

Dec. 22, 2006 (KR) ..... 10-2006-132485

(51) Int. Cl.
*A47L 5/00* (2006.01)

(52) U.S. Cl. ..... 15/329; 15/331; 15/323; 15/335

(58) Field of Classification Search ..... 15/323, 15/327.6, 329, 331, 334, 335; *A47L 5/00*
See application file for complete search history.

(56) References Cited

U.S. PATENT DOCUMENTS

| | | | | |
|---|---|---|---|---|
| 5,233,722 | A | 8/1993 | McKnight et al. | |
| 5,309,600 | A | 5/1994 | Weaver et al. | |
| 6,058,559 | A * | 5/2000 | Yoshimi et al. | 15/328 |

FOREIGN PATENT DOCUMENTS

| | | |
|---|---|---|
| JP | 11-009510 | 1/1999 |
| KR | 2004-0021041 | 7/2004 |

* cited by examiner

*Primary Examiner* — David A Redding
(74) *Attorney, Agent, or Firm* — Blank Rome LLP

(57) ABSTRACT

An upright vacuum cleaner that includes a suction assembly, a cleaner body, a supporting member, and mounting parts. The cleaner body has a dust collecting unit which is in communication with the suction assembly. The supporting member is formed as a single frame with a lower end hinged to the suction assembly. The cleaner body is detachable from a front surface of the supporting member. A width of the supporting member is narrower than the cleaner body. The mounting parts are formed on a rear surface of the supporting member and are provided in a longitudinal direction with respect to the supporting member. The mounting parts are also shaped to mount accessories.

20 Claims, 6 Drawing Sheets

UPRIGHT VACUUM CLEANER WITH A SINGLE FRAME SUPPORT FOR A SEPARABLE CLEANER BODY

CROSS-REFERENCE TO RELATED APPLICATION

This application claims the benefit of Korean Patent Application No. 10-2006-132485, filed on Dec. 22, 2006, in the Korean Intellectual Property Office, the entire disclosure of which is incorporated herein by reference.

FIELD OF THE INVENTION

The present invention relates to a vacuum cleaner, and more particularly, to an upright vacuum cleaner with a separable cleaner body having a dust collecting unit and a suction motor.

BACKGROUND OF THE INVENTION

In general, a conventional upright vacuum cleaner draws in dust and dirt along with air by using a suction force generated by its cleaner body, and thus cleans the surface to be cleaned, such as a floor, a carpet or the like.

Such a conventional upright vacuum cleaner is provided with the cleaner body and a suction assembly. The suction assembly is installed at a lower part of the cleaner body and moves over the surface to be cleaned. The cleaner body has a dust collecting unit and a motor chamber. The dust collecting unit is located inside the cleaner body and collects the dust or dirt drawn in from the surface to be cleaned. The motor chamber provides a mount for a suction motor below the dust collecting unit.

However, in the conventional upright vacuum cleaner, the cleaner body is hinged to the suction assembly and cannot be separated therefrom. Accordingly, if the conventional vacuum cleaner is cleaning a narrow surface, such as a stairway, a gap, or the like, several problems occur. For example, the conventional vacuum cleaner is difficult to move because the cleaner body is integrally formed with the suction assembly. Also, cleaning is more difficult due to the weight of the cleaner. Further, to clean a narrow area with a conventional vacuum cleaner, a user has to either purchase a subsidiary brush or an accessory for the conventional vacuum cleaner or purchase an entirely separate canister vacuum cleaner.

To address the problems described above, as described in Korean Patent No. 474083 to the present applicant, a vacuum cleaner is configured so that the cleaner body is separable from the vacuum cleaner, thereby allowing the vacuum cleaner to be used as both a canister vacuum cleaner and an upright vacuum cleaner. However, such a vacuum cleaner with a separable cleaner body has a comparatively larger size because supporting members on which the cleaner body is mounted must necessarily be larger than the circumference of the cleaner body.

Also, accessories for the vacuum cleaner are often mounted on the rear of the cleaner body and not on the supporting members on which the cleaner body is mounted. The accessories are mounted on the rear of the cleaner body to reduce the overall size of the vacuum cleaner. However, an extended hose is also often mounted in the rear of the cleaner body, thereby limiting the number of accessories that may be mounted on the cleaner body.

Moreover, when the cleaner body is separated from the supporting members, the accessories are also moved, even if they are not in use, because they are mounted on the cleaner body. As a result, if the surface or area to be cleaned is confined or narrow, the accessories mounted on the cleaner body must be removed prior to accessing the area to be cleaned, thus disrupting the cleaning operation.

SUMMARY OF THE INVENTION

Accordingly, an aspect of the present invention is to provide an upright vacuum cleaner with a cleaner body which can be separated from or assembled with a supporting member, thereby allowing the vacuum cleaner to used like a canister type cleaner as well as an upright type cleaner. The upright vacuum cleaner can also mount a large number of accessories while maintaining a compact volume.

One embodiment of the present invention provides an upright vacuum cleaner. The upright vacuum cleaner includes a suction assembly, a cleaner body, a supporting member, and mounting parts. The cleaner body has a dust collecting unit which is in communication with the suction assembly. The supporting member has a lower end hinged to the suction assembly and is formed of a single frame with front and rear surfaces. The front surface of the supporting member detachably couples to the cleaner body. A width of the supporting member is narrower than the width of the cleaner body. The mounting parts are formed on a rear surface of the supporting member and are provided in a longitudinal direction with respect to the supporting member. The mounting parts are also shaped to mount accessories.

Another embodiment of the present invention provides an upright vacuum cleaner. The upright vacuum cleaner includes a suction assembly, a cleaner body, an extended hose, an inflow duct, a discharging duct, a supporting member, and mounting parts. The cleaner body has a dust collecting unit communicating with the suction assembly. The extended hoses is detachably disposed on the cleaner body and has a fixed end coupled to a lower part of the cleaner body. The inflow duct is on a rear surface of the cleaner body and has one end communicating with the fixed end of the extended hose and the other end communicating with the dust collecting unit. The discharging duct is on the rear surface of the cleaner body and has one end communicating with the dust collecting unit and the other end communicating with a motor chamber of the cleaner body. The supporting member has a lower end hinged to the suction assembly and is formed of a single frame with front and rear surfaces. The front surface detachably couples with the cleaner body. The supporting member has a width that substantially corresponds to the distance between the inflow duct and the discharging duct. The mounting parts are formed on a rear surface of the supporting member and are provided in a longitudinal direction with respect to the supporting member. The mounting parts are also shaped to mount accessories.

Yet another embodiment of the present invention provides an upright vacuum cleaner. The upright vacuum cleaner includes a suction assembly, a cleaner body with a dust collecting unit communicating with the suction assembly, an extended hose, an inflow duct, a discharging duct, a supporting member, coupling projections, and mounting parts. The extended hoses has a free end and a fixed end coupled to a lower part of the cleaner body. The extended hose is detachably disposed on an upper part and a side part of the cleaner body. The inflow duct is on a rear surface of the cleaner body and has one end communicating with the fixed end of the extended hose and the other end communicating with the dust collecting unit. The discharging duct is substantially on another side of the rear surface of the cleaner body and has one end communicating with the dust collecting unit and the other end communicating with a motor chamber of the cleaner body. The supporting member has a lower end hinged to the suction assembly and is formed of a single frame with front and rear surfaces. The front surface detachably couples with the cleaner body. The supporting member has a width that substantially corresponds to the distance between the inflow duct and the discharging duct. The coupling projections are formed on the front surface of the supporting member and couple to the rear surface of the cleaner body. The coupling projections are disposed to restrain the cleaner body when the cleaner body is coupled to the supporting member. The mounting parts are on the rear surface and a side surface of the supporting member and are shaped to mount accessories.

BRIEF DESCRIPTION OF THE DRAWINGS

The above aspects and other advantages of the present invention will be more apparent by describing an exemplary embodiment of the present invention with reference to the accompanying drawing figures, in which.

In the drawing figures, it should be understood that like reference numerals refer to like features and structures.

DETAILED DESCRIPTION OF THE INVENTION

Hereinafter, an upright vacuum cleaner according to an exemplary embodiment of the present invention will now be described in greater detail with reference to the accompanying drawing figures.

Figure 1:
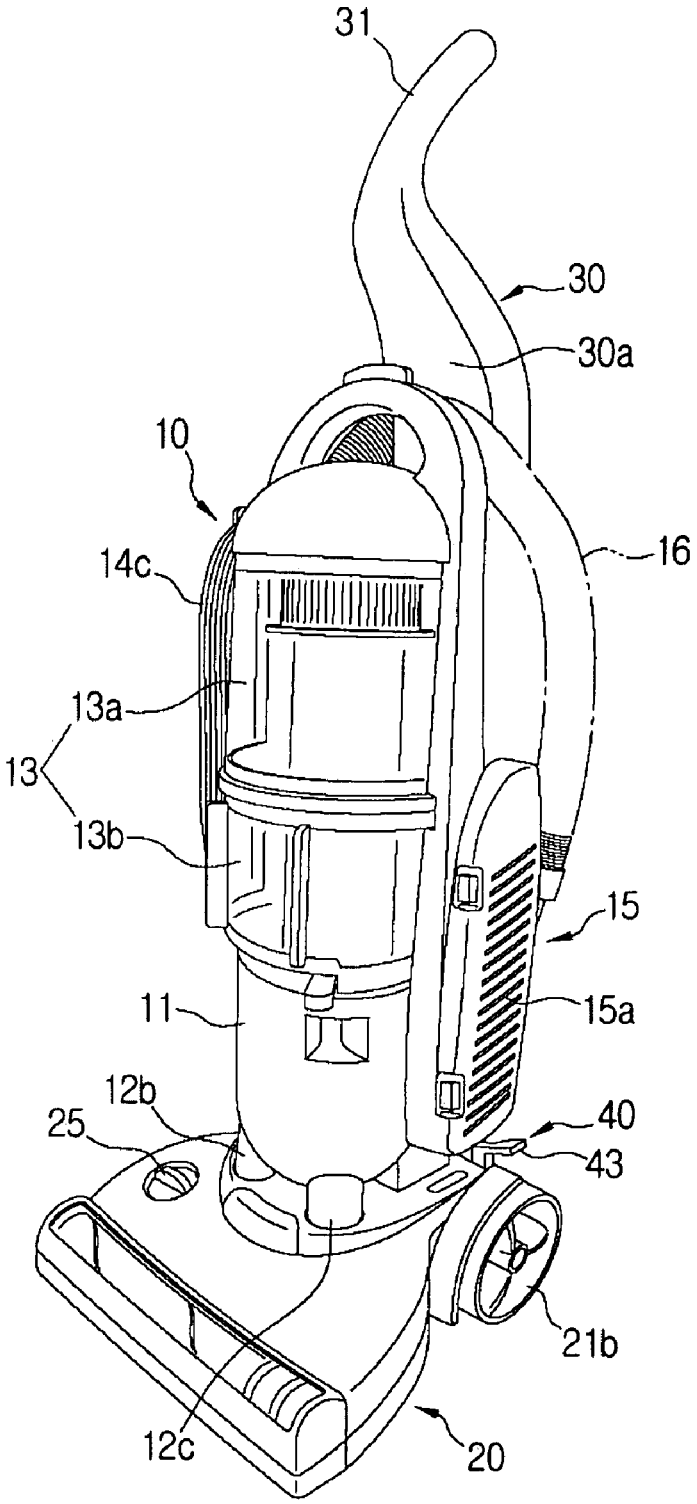
FIG. 1 is a perspective view of an upright vacuum cleaner according to an exemplary embodiment of the present invention.

Referring to FIG. 1, an upright vacuum cleaner generally includes a cleaner body 10, a suction assembly 20, a supporting member 30, and a locking unit 40. The supporting member 30 is hinged at its lower end to the suction assembly 20. The supporting member 30 has a handle part 31 extending from an upper end thereof. The cleaner body 10 is detachably mounted to the supporting member 30.

The cleaner body 10 has a lower part 11, a dust collecting unit 13, and an air discharging filter part 15. A motor chamber is formed in the lower part 11 to mount a suction motor (not illustrated) therein. The dust collecting unit 13 is disposed above the lower part 11 and isolated from the motor chamber. The dust collecting unit 13 includes a cyclone part 13*a* and a dust bin 13*b*. The cyclone part 13*a* separates the dust or dirt drawn in along with the air from air and then discharges the air. The dust bin 13*b* collects the dust or dirt and is detachably assembled between the cyclone part 13*a* and the lower part 11 of the cleaner body 10. The air discharging filter part 15 accommodates a filter (not illustrated) and has a grill cover 15*a* for accessing the filter within the air discharging filter part 15. The air discharging filter part 15 is disposed on one side surface of the cleaner body 10 to filter the air discharged from the cyclone part 13*a*. The air discharging filter part 15 then discharges the filtered air from the cleaner body 10. Thus, in the embodiment where the air discharging filter part 15 is disposed on the one side surface of the cleaner body 10, a user who usually stands in the rear of the vacuum cleaner is not directly exposed to the air discharged from the air discharging filter part 15.

The locking unit 40 fixes the supporting member 30 in a substantially vertical state. The locking unit 40 is preferably disposed near where the suction assembly 20 and the supporting member 30 are hinged to each other and near the second wheel 21*b*. The locking unit 40 has an operating lever 43. By actuating the operating lever 43, the locking unit 40 releases the supporting member 30 from the substantially vertical state allowing it to freely pivot about a lower end thereof.

Figure 2:
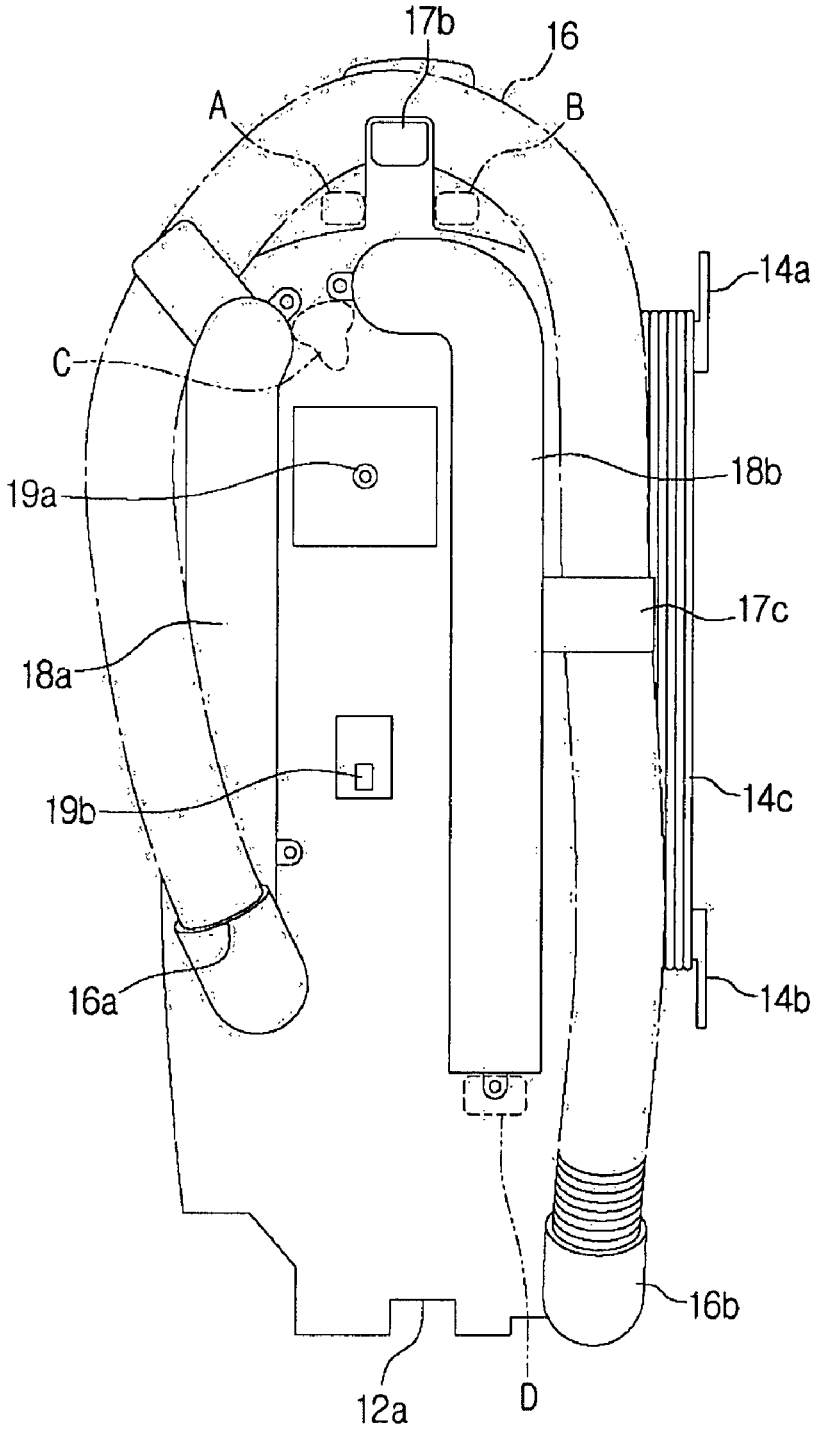
FIG. 2 is a rear view of a cleaner body of the upright vacuum cleaner illustrated in FIG. 1.

Referring to FIG. 2, the cleaner body 10 generally includes a power cord 14*c*, an extended hose 16, an inflow duct 18*a*, a discharging duct 18*b*, a first guide projection 19*a*, a second guide projection 19*b*, and several areas A, B, C, and D. The extended hose 16, the inflow duct 18*a*, the discharging duct 18*b*, and first and second guide projections 19*a* and 19*b* are disposed on a rear surface of the cleaner body 10. The cleaner body 10 has the power cord 14*c*, which is wound on a pair of winding projections 14*a* and 14*b* formed in a spaced-apart relation from each other at the side of the cleaner body 10.

The extended hose 16 has an end 16*a* connected to a lower part of the rear surface of the cleaner body 10 and another end 16*b*, which is free. The other end 16*b* of the extended hose 16 can be coupled to a connecting port 22 (shown in FIG. 3) of the suction assembly 20 or with any one of a plurality of accessories 34*a*, 34*b*, 34*c*, and 34*d* (shown in FIG. 4). The extended hose 16 is disposed to surround substantially a rear upper part and a side part of the cleaner body 10. The extended hose 16 is detachably fixed by a first hose fixing part 17*a*, a second hose fixing part 17*b*, and a third hose fixing part 17*c* projecting from the cleaner body 10 in a spaced-apart relation from one another.

The inflow duct 18*a* is provided in a longitudinal direction on the rear surface of the cleaner body 10. The inflow duct 18*a* has one end communicating with the end 16*a* of the extended hose 16 and another end communicating with the cyclone part 13*a* of the dust collecting unit 13.

The discharging duct 18*b* is provided in the longitudinal direction of the cleaner body 10 on the rear surface of the cleaner body 10 spaced apart from the inflow duct 18*a*. The discharging duct 18*b* has an end communicating with an air discharging hole (not illustrated) of the cyclone part 13*a* of the dust collecting unit 13 and another end communicating with the motor chamber disposed in the lower part 11 of the cleaner body 10.

The first and the second guide projections 19*a* and 19*b* are provided in a spaced-apart relation from each other between the inflow duct 18*a* and the discharging duct 18*b*. The first and the second guide projections 19*a* and 19*b* align the cleaner body 10 for mounting on the supporting member 30. The number of guide projections illustrated is exemplary only and is not intended to be limiting; the optimal number of guide projections may be less or more than the two depicted.

Several areas are provided on the rear surface of the cleaner body 10 for stable mounting on the supporting member 30. The areas detachably engage coupling projections (shown in FIG. 3) on the supporting member 30. In the embodiment shown in the figure, the cleaner body l includes area A, area B, area C, and area D. Area A and area B are provided at the upper end of the cleaner body 10. Area C is provided at a substantially center portion of the cleaner body 10. Preferably, the area C is between the inflow duct 18*a* and the discharging duct 18*b*. Area D is provided at a lower portion of the cleaner body 10. The number of areas illustrated is exemplary only and is not intended to be limiting; the optimal number of areas may be less or more than the four depicted.

Figure 3:
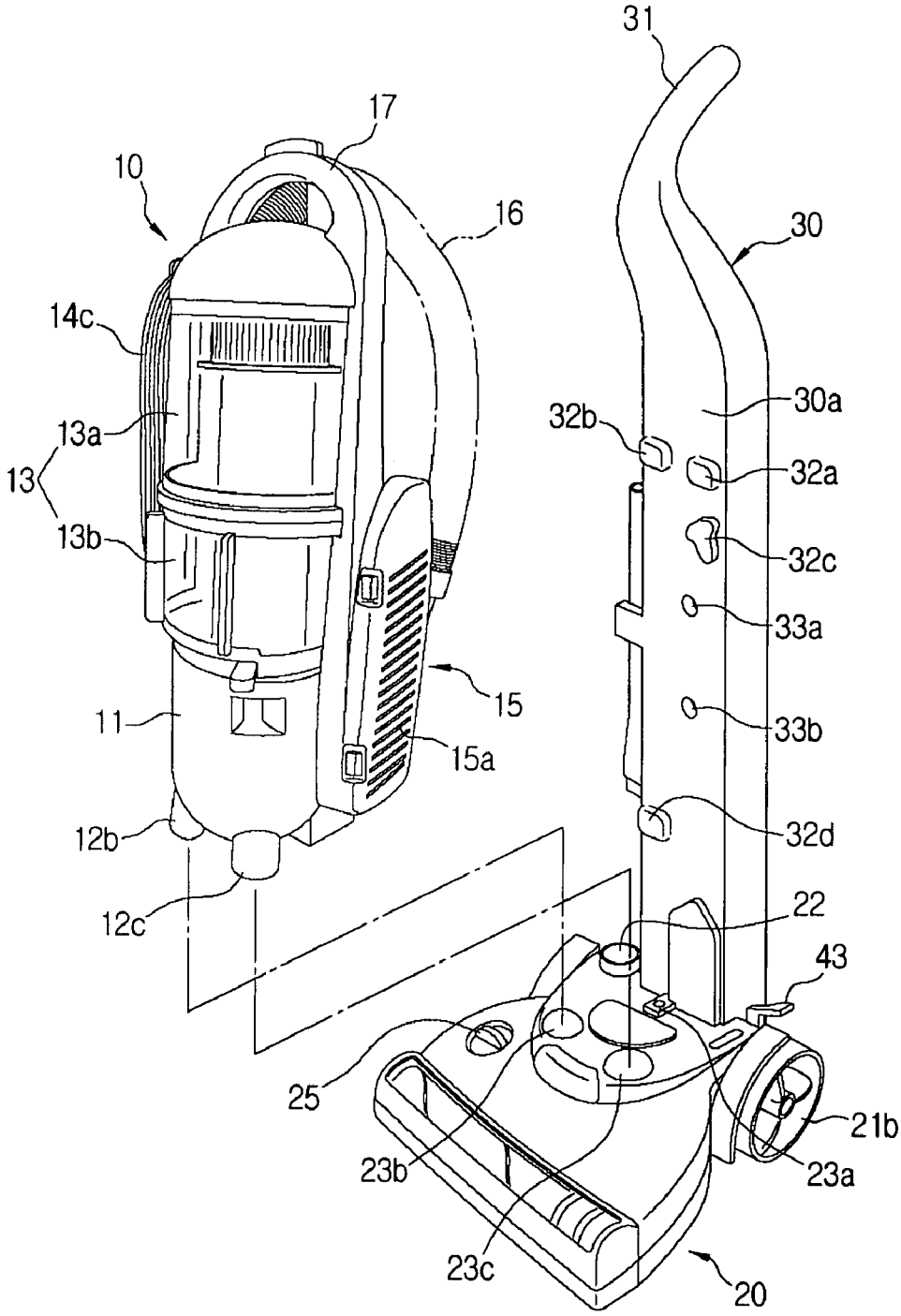
FIG. 3 is an exploded view of the upright vacuum cleaner illustrated in FIG. 1 when the cleaner body is separated from a supporting member.

Referring to FIG. 3, an exploded view of the upright vacuum cleaner with the cleaner body 10 separated is shown. The suction assembly 20 may have a first wheel 21*a* (shown in FIG. 4), a second wheel 21*b*, the connection port 22, several fixing projections 23*a*, 23*b*, and 23*c*, and a height adjusting knob 25. The first and second wheels 21*a* and 21*b* are rotatably assembled on both sides of the rear of the suction assembly 20 to smoothly move the suction assembly 20 onto the surface to be cleaned.

The height adjusting knob 25 disposed on the suction assembly 20 to adjust a height of the suction assembly 20.

The suction assembly 20 also has an inlet (not illustrated) formed at an under surface thereof to draw in the air from the surface to be cleaned. The connecting port 22 is disposed on the suction assembly 20 and is in communication with the inlet of the suction assembly 20. The connecting port 22 is also detachably connected to the other end 16*b* of the connecting hose 16 and guides the air and dirt or dust drawn in from the inlet to the connecting hose 16.

The fixing projections 23*a*, 23*b*, and 23*c* are disposed on an upper surface of the suction assembly 20 in a spaced-apart relation from one another. The cleaner body 10 is seated and disposed on the fixing projections 23*a*, 23*b*, and 23*c*. In the embodiment shown, to fix the cleaner body 10 stably on the upper surface of the suction assembly 20, the fixing projections 23*a*, 23*b*, and 23*c* are disposed in a substantially triangular arrangement. Also in the embodiment shown, the first fixing projection 23*a* is detachably inserted in an inserting groove 12*a* (shown in FIG. 2) formed at the rear of a lower portion of the cleaner body 10. Further in the embodiment shown, the second and the third fixing projections 23*b* and 23*c* mate with the seating parts 12*b* and 12*c*, respectively, formed in the front lower portion of the cleaner body 10.

The cleaner body 10 may include a handle 17 for the user to separate the cleaner body 10 from the supporting member 30 and the suction assembly 20. The handle 17 is preferably provided on the upper part of the cleaner body 10. The handle 17 also allows the user to mount the cleaner body 10 on the supporting member 30 and the suction assembly 20.

The supporting member 30 may be formed as a single frame with a predetermined length. Preferably, the supporting member 30 is formed so that it has a width corresponding to a distance between the inflow duct 18*a* and the discharging duct 18*b*. The supporting member 30 has several coupling projections 32*a*-33*d* and guide holes 33*a*-33*b* on its front surface 30*a* for detachably mounting and aligning the cleaner body 10 to the front surface 30*a* of the supporting member 30.

In the embodiment shown in the figure, the supporting member 30 has a first upper coupling projection 32*a*, a second upper coupling projection 33*b*, a third upper coupling projection 32*c*, a lower coupling projection 32*d*, a first guide hole 33*a*, and a second guide hole 33*b*. The coupling projections are formed in a spaced-apart relation from one another on a front surface 30*a* of the supporting member 30. In the embodiment depicted, the first and the second upper coupling projections 32*a* and 32*b* are located to correspond to areas A and B (shown in FIG. 2) at the upper end of the cleaner body 10, the third upper coupling projection 32*c* is located to correspond to area C (shown in FIG. 2) at a substantially center portion of the cleaner body 10, and the lower coupling projection 32*d* is located to correspond to area D (shown in FIG. 2) at a lower portion of the cleaner body 10. The positions of the upper coupling projections 32*a* 32*b* and 32*c* and the lower coupling projection 32*d* are set so that when the cleaner body 10 is mounted on the front surface 30*a* of the supporting member 30, the first and the second upper coupling projections 32*a* and 32*b* press the cleaner body 10 downward at areas A and B and the lower coupling projection 32*d* presses the lower portion of the cleaner body 10 upward at the area D. Accordingly, the cleaner body 10 cannot freely move up or down but is stably fixed on the supporting member 30. In addition, the third upper coupling projection 32*c* mates with the area C to prevent the cleaner body 10 from freely moving left or right. Accordingly, the cleaner body 10 is more stably mounted on the supporting member 30.

The first guide hole 33*a* and the second guide hole 33*b* are formed on the front surface 30*a* of the supporting member 30. The first guide projection 19*a* and the second guide projection 19*b* (shown in FIG. 2) formed on the rear surface of the cleaner body 10 are inserted into the first and the second guide holes 33*a* and 33*b*. The first and the second guide projections 19*a* and 19*b* and the first and the second guide holes 33*a* and 33*b* align the cleaner body 10 for mounting on the front surface 30*a* of the supporting member 30.

Figure 4:
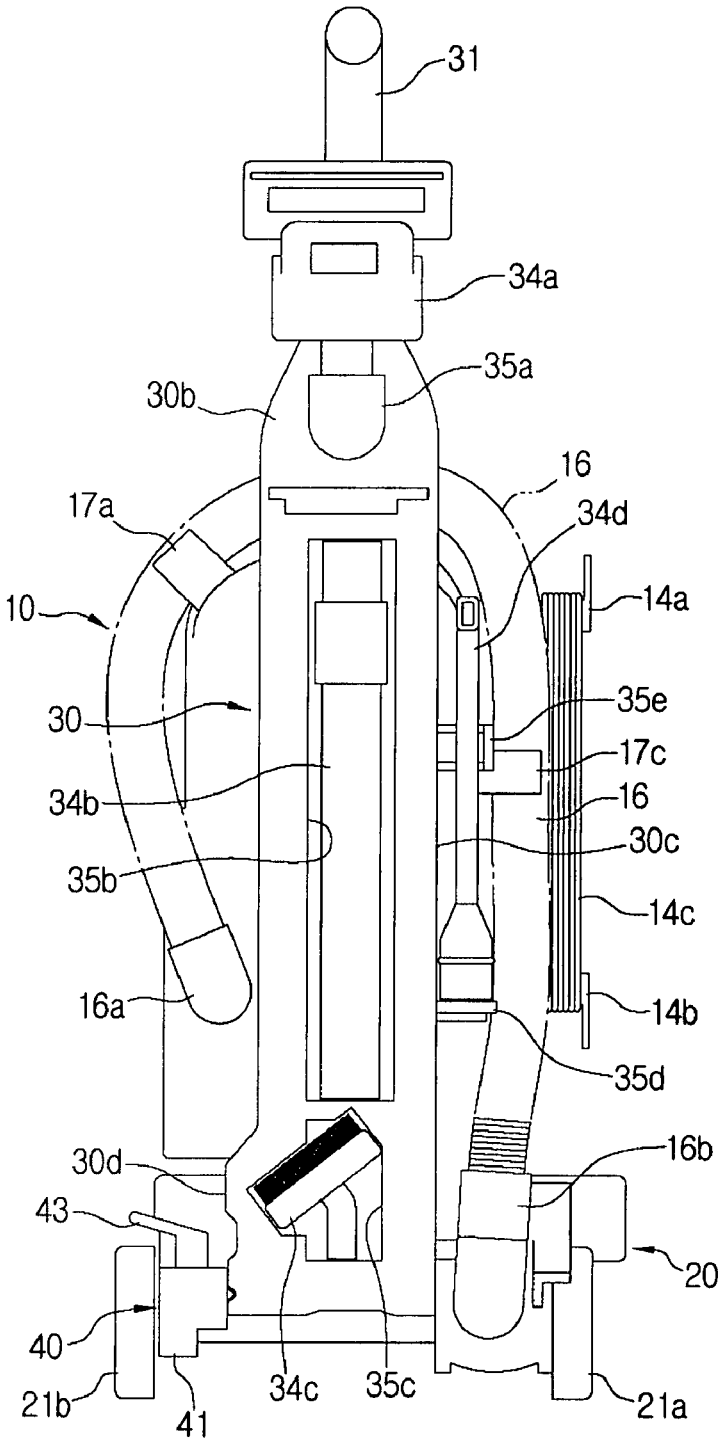
FIG. 4 is a rear view of the upright vacuum cleaner illustrated in FIG. 1.

Referring to FIG. 4, a rear surface 30*b* of the supporting member 30 has several mounting parts 35*a*-35*e* and several accessories 34*a*-34*d*. In the embodiment shown, the rear surface 30*b* has a first mounting part 35*a*, a second mounting part 35*b*, a third mounting part 35*c*, and a pair of supporting projections 35*d* and 35*e*. The mounting parts 35*a*, 35*b*, and 35*c* are preferably formed along a longitudinal direction on the rear surface 30*b* of the supporting member 30 to mount a plurality of accessories 34*a*, 34*b* and 34*c* thereon. The first mounting part 35*a* is a recessed groove opened upward from an upper side of the rear surface 30*b*. In this embodiment, a rear end of a turbo brush 34*a* is detachably mounted to the first mounting part 35*a*. Also, the second mounting part 35*b* is a recessed groove disposed below the first mounting part 35*a* and has a predetermined length to mount a telescopic pipe 34*b* capable of extending its length. Furthermore in the embodiment depicted, the third mounting part 35*c* detachably mounts a dust brush 34*c* and is formed as a recessed groove with a shape corresponding to the contour of the dust brush 34*c*. The third mounting part 35*c* is below the second mounting part 35*b*. Also, the pair of supporting projections 35*d* and 35*e* are formed to detachably mount a crevice tool 34*d* which is used when cleaning a break or a gap. The supporting projections 35*d* and 35*e* are disposed on a side surface 30*c* of the supporting member 30.

Figure 5A:
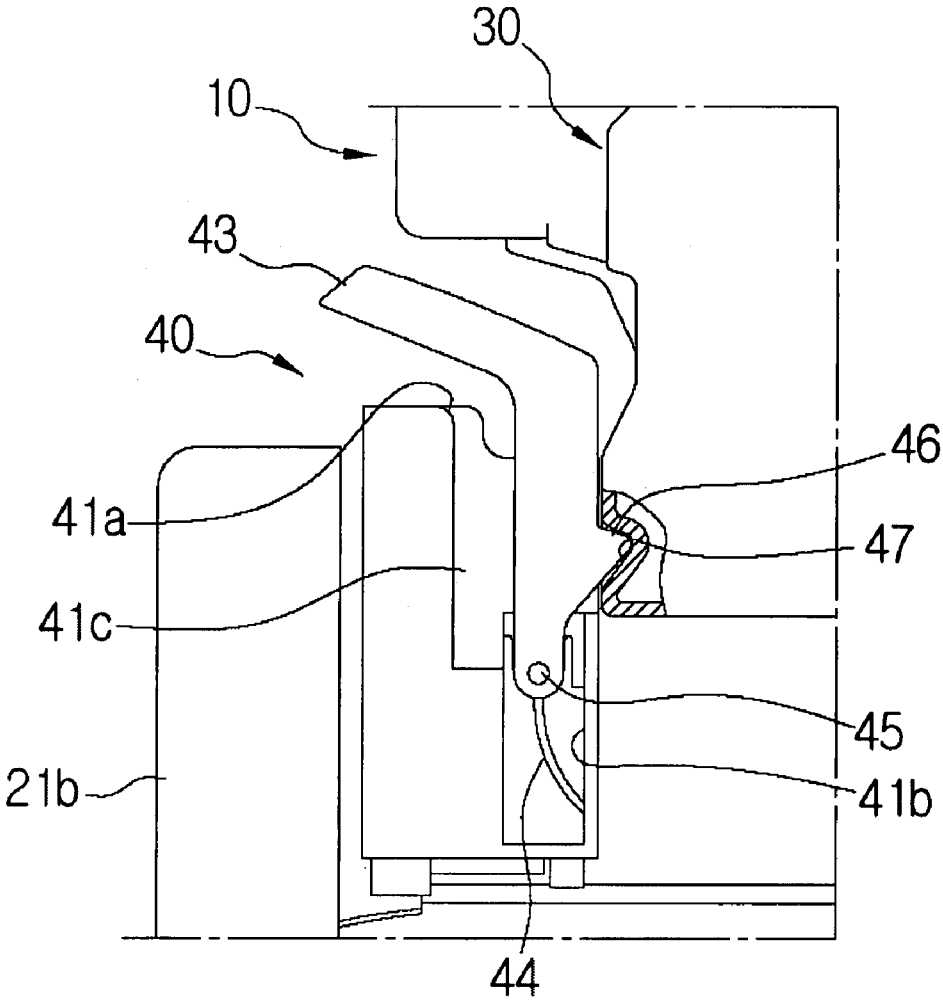
FIGS. 5A and 5B are partial cross-sectional views of a locking unit of the upright vacuum cleaner showing the supporting member locked and unlocked.
Figure 5B:
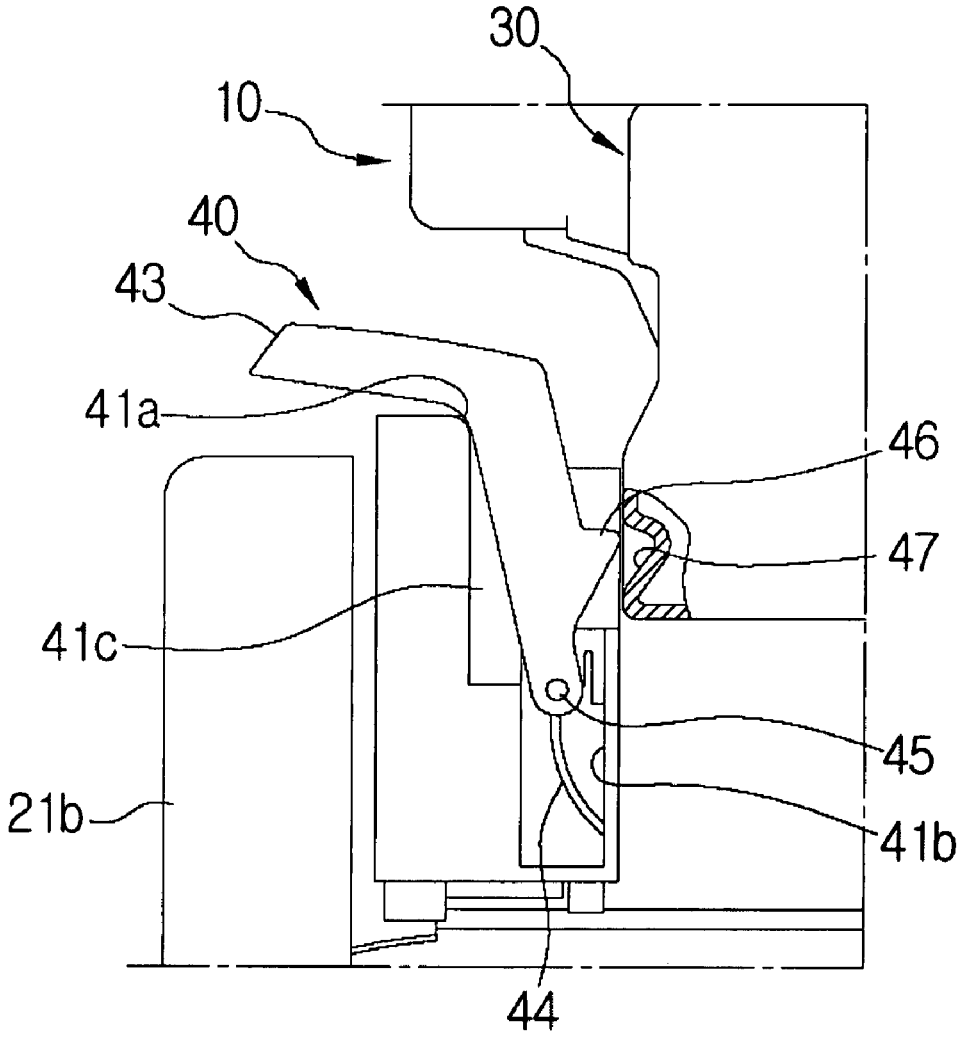

Referring to FIGS. 5A and 5B, the locking unit 40 may include the fixing bracket 41 (shown in FIG. 4), a corner part 41*a*, an inner wall 41*b*, a space part 41*c*, the operating lever 43, an elastic piece 44, a hinge pin 45, a hanging projection 46, and an inserting groove 47. The fixing bracket 41 is preferably disposed between the second wheel 21*b* and the suction assembly 20. The operating lever 43 is disposed within the fixing bracket 41. An upper part of the operating lever 43 projects outwardly from an upper side of the fixing bracket 41, so that the user can actuate the operating lever 43 by pressing the upper part. The operating lever 43 has a lower part pivotably connected to the space part 41*c* by the hinge pin 45. The operating lever 43 can be pivoted within the space part 41*c*, but the corner part 41*a* restricts the pivoting of the operating lever 43 to a predetermined maximum pivoting angle.

The elastic piece 44 is coupled to the lower part of the operating lever 43 so that the operating lever 43 is elastically supported in the fixing bracket 41. The elastic piece 44 is preferably bent. A free end of the elastic piece 44 curves toward and is supported by the inner wall 41*b*.

The hanging projection 46 is formed at a side of the operating lever 43 which faces the supporting member 30. The hanging projection 46 inserts into the inserting groove 47. The inserting groove 47 is formed on a lower part of the other side surface 30*d* of the supporting member 30. Accordingly, when the hanging projection 46 is inserted into the inserting groove 47, the supporting member 30 is restrained from pivoting and thus is maintained in a substantially vertical position. When the hanging projection 46 is separated from the inserting groove 47, the supporting member 30 can freely pivot.

The upright vacuum cleaner according to the exemplary embodiment of the present invention provides the supporting member 30 on which the cleaner body 10 is mounted as a single frame in the from of a bar with the width being narrower than that the cleaner body 10. Accordingly, the upright vacuum cleaner of the present invention has a relatively smaller volume or size when compared to the conventional upright vacuum cleaner.

Moreover, the upright vacuum cleaner according to the exemplary embodiment of the present invention can mount a large number of accessories 34*a*, 34*b*, 34*c*, and 34*d* on the supporting member 30, while maintaining the small size. Also, because the accessories 34*a*, 34*b*, 34*c*, and 34*d* are mounted on the supporting member 30 and not on the cleaner body 10 like the conventional upright vacuum cleaner with the separable cleaner body, the cleaner body 10 can be used separately without being encumbered by the accessories 34*a*, 34*b*, 34*c*, and/or 34*d*. As a result, the user can continue cleaning without having to stop to remove the accessories or mount them elsewhere.

As apparent from the foregoing description, according to the exemplary embodiment of the present invention, the vacuum cleaner is configured, so that the supporting member from which the cleaner body is separated is formed as a single frame substantially in the from of a bar. Accordingly, the vacuum cleaner according to the exemplary embodiment of the present invention is advantageous in that its total size and volume are reduced.

Also, the vacuum cleaner according to the exemplary embodiment of the present invention is configured, so that the extended hose is disposed substantially along the sides of the cleaner body, the air discharging filter part is disposed on the side surface of the cleaner body, and the locking unit for locking the supporting member vertically is disposed on one side of the suction assembly. Accordingly, the vacuum cleaner according to the exemplary embodiment of the present invention provides a greater area for mounting accessories and thus more accessories can be mounted.

Although a representative exemplary embodiment of the present invention has been shown and described in order to exemplify the principles of the present invention, the present invention is not limited to the specific exemplary embodiment described. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. An upright vacuum cleaner, comprising:

a suction assembly;

a cleaner body having a dust collecting unit communicating with the suction assembly;

a supporting member having a lower end hinged to the suction assembly, the supporting member being formed of a single frame with front and rear surfaces; the front surface of the supporting member being detachably coupled to the cleaner body, and the supporting member having a width narrower than the width of the cleaner body; and a plurality of mounting parts formed in the rear surface of the supporting member, the plurality of mounting parts provided in a longitudinal orientation with respect to the supporting member, each of the plurality of mounting parts being shaped to receive an accessory insertable therein.

2. The upright vacuum cleaner of claim 1, wherein the plurality of mounting parts are formed on a side surface of the supporting member.

3. The upright vacuum cleaner of claim 1, wherein the cleaner body further comprises an extended hose having one end coupled to a lower part thereof and a free end.

4. The upright vacuum cleaner of claim 3, wherein the extended hose is detachably disposed on an upper part and a side part of the cleaner body.

5. The upright vacuum cleaner of claim 3, wherein the free end of the extended hose detachably couples with the suction assembly.

6. The upright vacuum cleaner of claim 3, wherein the free end of the extended hose detachably couples with one of the plurality of accessories.

7. The upright vacuum cleaner of claim 3, wherein the cleaner body further comprises:

an inflow duct provided substantially on one side of a rear surface of the cleaner body and having one end communicating with the fixed end of the extended hose and the other end communicating with the dust collecting unit; and a discharging duct provided substantially on another side of the rear surface of the cleaner body and having one end communicating with the dust collecting unit and the other end communicating with a motor chamber of the cleaner body.

8. The upright vacuum cleaner of claim 7, wherein the supporting member has a width substantially corresponding to a distance between the inflow duct and the discharging duct.

9. The upright vacuum cleaner of claim 1, wherein the cleaner body further comprises an air discharging filter part disposed on a side surface of the cleaner body so as not to interfere with the mounting of the cleaner body to the supporting member.

10. The upright vacuum cleaner of claim 1, wherein the suction assembly further comprises a locking unit for maintaining the supporting member in a substantially vertical position, and releasing the supporting member from the vertical position, the locking unit being disposed on a side surface of the suction assembly, thereby providing a space for mounting the plurality of accessories on the rear surface of the supporting member.

11. The upright vacuum cleaner of claim 10, wherein the locking unit comprises:

a fixing bracket disposed on the side surface of the suction assembly;

an operating lever elastically hinged on the fixing bracket and having a hanging projection on a side thereof; and an inserting groove formed on the lower end of the supporting member to receive the hanging projection of the operating lever, and whereby the supporting member is restrained from rotating and thus maintained substantially vertically when the hanging projection is received in the inserting groove, and the supporting member is free to rotate when the operating lever separates the hanging projection from the inserting groove.

12. The upright vacuum cleaner of claim 1, wherein the supporting member further comprises coupling projections formed on the front surface of the supporting member, the coupling projections coupling to a rear surface of the cleaner body, the coupling projections disposed to restrain the cleaner body when the cleaner body is coupled to the supporting member.

13. An upright vacuum cleaner, comprising:

a suction assembly;

a cleaner body having a dust collecting unit communicating with the suction assembly;

an extended hose detachably disposed on the cleaner body, the extended hose having a fixed end coupled to a lower part of the cleaner body;

an inflow duct provided on a rear surface of the cleaner body and having one end communicating with the fixed end of the extended hose and the other end communicating with the dust collecting unit;

a discharging duct provided on the rear surface of the cleaner body and having one end communicating with the dust collecting unit and the other end communicating with a motor chamber of the cleaner body;

a supporting member having a lower end hinged to the suction assembly, the supporting member formed of a single frame with front and rear surfaces; the front surface of the supporting member being detachably coupled to the cleaner body, the supporting member having a width substantially corresponding to a distance between the inflow duct and the discharging duct; and a plurality of mounting parts formed on the rear surface and a side surface of the supporting member, the plurality of mounting parts provided in a longitudinal orientation with respect to the supporting member, the plurality of mounting parts shaped to mount a plurality of accessories.

14. The upright vacuum cleaner of claim 13, wherein the supporting member further comprises coupling projections formed on the front surface of the supporting member, the coupling projections coupling to the rear surface of the cleaner body, the coupling projections configured to restrain the cleaner body when the cleaner body is coupled to the supporting member.

15. The upright vacuum cleaner of claim 13, wherein the extended hose has a free end.

16. The upright vacuum cleaner of claim 13, wherein the extended hose is detachably disposed on an upper part and a side part of the cleaner body.

17. The upright vacuum cleaner of claim 14, wherein the free end of the extended hose detachably couples with the suction assembly.

18. The upright vacuum cleaner of claim 14, wherein the free end of the extended hose detachably couples with one of the plurality of accessories.

19. An upright vacuum cleaner, comprising:

a suction assembly;

a cleaner body having a dust collecting unit communicating with the suction assembly;

an extended hose having a free end and a fixed end coupled to a lower part of the cleaner body, the extended hose detachably disposed on an upper part and a side part of the cleaner body;

an inflow duct provided on a rear surface of the cleaner body and having one end communicating with the fixed end of the extended hose and the other end communicating with the dust collecting unit;

a discharging duct provided on the rear surface of the cleaner body and having one end communicating with the dust collecting unit and the other end communicating with a motor chamber of the cleaner body;

a supporting member having a lower end hinged to the suction assembly, the supporting member formed of a single frame with a front and rear surfaces; the front surface of the supporting member being detachably coupled to the cleaner body, the supporting member having a width substantially corresponding to a distance between the inflow duct and the discharging duct;

a plurality of coupling projections formed on the front surface of the supporting member, the coupling projections coupling to the rear surface of the cleaner body, the coupling projections disposed to restrain the cleaner body when the cleaner body is coupled to the supporting member; and a plurality of mounting parts formed on the rear surface and a side surface of the supporting member, the plurality of mounting parts shaped to mount a plurality of accessories.

20. The upright vacuum cleaner of claim 19, wherein the free end of the extended hose detachably couples with the suction assembly or one of the plurality of accessories.

* * * * *